US008877411B2

(12) United States Patent
Jun et al.

(10) Patent No.: US 8,877,411 B2
(45) Date of Patent: Nov. 4, 2014

(54) MULTILAYER ELECTROPHOTOGRAPHIC PHOTOCONDUCTOR AND IMAGE-FORMING APPARATUS

(75) Inventors: Azuma Jun, Osaka (JP); Maruo Keiji, Osaka (JP); Hamasaki Kazunari, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 101 days.

(21) Appl. No.: 13/211,653

(22) Filed: Aug. 17, 2011

(65) Prior Publication Data

US 2012/0052425 A1 Mar. 1, 2012

(30) Foreign Application Priority Data

Aug. 30, 2010 (JP) ..... 2010-192979

(51) Int. Cl.

| | |
|---|---|
| ***G03G 15/00*** | (2006.01) |
| ***G03G 15/02*** | (2006.01) |
| ***G03G 5/05*** | (2006.01) |
| ***G03G 5/06*** | (2006.01) |

(52) U.S. Cl.

CPC ..... *G03G 15/751* (2013.01); *G03G 5/0564* (2013.01); *G03G 5/0614* (2013.01)

USPC ..... 430/56; 430/58.05; 430/58.7; 430/59.2; 430/69; 399/159

(58) Field of Classification Search

CPC ..... G03G 5/04; G03G 5/043; G03G 5/07; G03G 5/0564; G03G 5/0605; G03G 5/0614

USPC ..... 430/56, 57.3, 58.7, 59.4; 399/159

See application file for complete search history.

(56) References Cited

U.S. PATENT DOCUMENTS

| | | | | |
|---|---|---|---|---|
| 6,289,190 | B1 * | 9/2001 | Amamiya et al. | 399/174 |
| 7,700,251 | B2 * | 4/2010 | Nakai et al. | 430/73 |
| 7,968,262 | B2 * | 6/2011 | Wu | 430/58.8 |

FOREIGN PATENT DOCUMENTS

| | | | |
|---|---|---|---|
| CN | 101762994 A | | 6/2010 |
| JP | 05-257299 | | 10/1993 |
| JP | 06-051544 | | 2/1994 |
| JP | 6-248066 | * | 9/1994 |
| JP | 06248066 | | 9/1994 |
| JP | 2007-122036 | | 5/2007 |
| JP | 2010-139646 | | 6/2010 |

OTHER PUBLICATIONS

Machine Translation of JPA6-248066, pp. 1-15.*

* cited by examiner

*Primary Examiner* — Thorl Chea

(74) *Attorney, Agent, or Firm* — Frommer Lawrence & Haug LLP

(57) ABSTRACT

An electrophotographic photoconductor includes an electrically conductive base and a photosensitive layer disposed on the electrically conductive base. The photosensitive layer has a structure 1) in which a charge-generation layer including at least a charge-generating material and a charge-transport layer including at least a charge-transporting material and a binder resin are stacked in that order, or a structure 2) in which at least the charge-generating material, the charge-transporting material, and the binder resin are included in the same layer, and the binder resin is a terpolymer polycarbonate resin represented by general formula (I) below.

General formula (I)

-continued
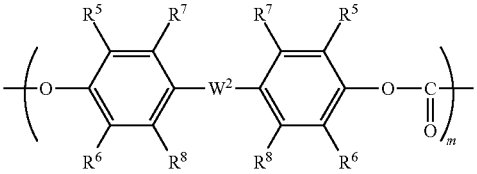
-continued
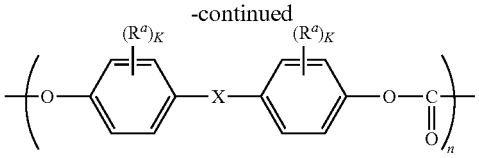
16 Claims, 3 Drawing Sheets

MULTILAYER ELECTROPHOTOGRAPHIC PHOTOCONDUCTOR AND IMAGE-FORMING APPARATUS

INCORPORATION BY REFERENCE

This application is based upon and claims the benefit of priority from the corresponding Japanese Patent Application No. 2010-192979, filed Aug. 30, 2010, the entire contents of which is incorporated herein by reference.

FIELD

The present disclosure relates to an electrophotographic photoconductor and an image-forming apparatus including the electrophotographic photoconductor.

BACKGROUND

As electrophotographic photoconductors for use in electrophotographic image-forming apparatuses, inorganic photoconductors having a photosensitive layer composed of an inorganic material, such as selenium, and organic photoconductors having a photosensitive layer mainly composed of organic materials, such as a binder resin, a charge-generating material, and a charge-transporting material are known.

Among these photoconductors, organic photoconductors have been widely used because of ease of production compared with inorganic photoconductors, wider selectivity of materials for the photosensitive layer, and higher design freedom.

Although organic photoconductors have such advantages, since most of organic materials are generally composed of soft materials, the photosensitive layer easily becomes worn with repeated use, which is a problem.

Accordingly, many studies have been conducted on improvement in abrasion resistance of the photosensitive layer of organic photoconductors, and organic photoconductors with improved abrasion resistance have been proposed.

SUMMARY

According to an aspect of some embodiments of the present disclosure, an electrophotographic photoconductor includes an electrically conductive base and a photosensitive layer disposed on the electrically conductive base, in which the photosensitive layer has a structure 1) in which a charge-generation layer including at least a charge-generating material and a charge-transport layer including at least a charge-transporting material and a binder resin are stacked in that order, or a structure 2) in which at least the charge-generating material, the charge-transporting material, and the binder resin are included in the same layer, and the binder resin is a terpolymer polycarbonate resin represented by general formula (I) below.

General formula (I)

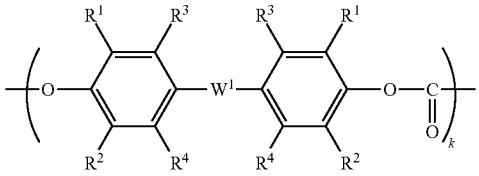

-continued

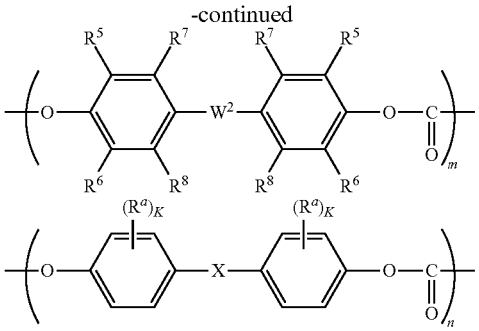

In general formula (I), k+m+n=1 and 0.3≤k+m≤0.8; $W^1$ and $W^2$ each independently represent a single bond, —O—, or —CO—; $R^1$ to $R^8$ and $R^a$ each independently represent a hydrogen atom, an alkyl group, or an aryl group; K represents an integer of 0 to 4; and X represents an alkylidene group or a cycloalkylidene group; provided that the case where $R^1$ and $R^5$ are the same, $R^2$ and $R^6$ are the same, $R^3$ and $R^7$ are the same, $R^4$ and $R^8$ are the same, and $W^1$ and $W^2$ are the same simultaneously is excluded.

According to some aspects of some embodiments of the present disclosure, an image-forming apparatus includes an image-bearing member, a charging portion operable for charging the surface of the image-bearing member, an exposing portion operable for exposing the surface of the image-bearing member and forming an electrostatic latent image, a developing portion operable for developing the electrostatic latent image to form a toner image, and a transferring portion operable for transferring the toner image from the image-bearing member to a recording media, in which the image-bearing member comprises the electrophotographic photoconductor described above.

The above and other objects, features, and advantages of various embodiments of the present disclosure will be more apparent from the following detailed description of embodiments taken in conjunction with the accompanying drawings.

In the text, the terms "comprising", "comprise", "comprises" and other forms of "comprise" can have the meaning ascribed to these terms in U.S. Patent Law and can mean "including", "include", "includes" and other forms of "include". The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "or" equivalent to the term "and/or," unless the context clearly dictates otherwise. The term "based on" is not exclusive and allows for being based on additional factors not described, unless the context clearly dictates otherwise.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION

Figure 1A:
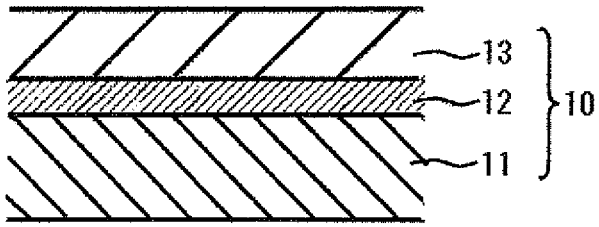
FIGS. 1A and 1B are cross-sectional views each showing structures of a multilayer electrophotographic photoconductor according to some embodiments of the present disclosure.

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present embodiments without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Some embodiments relate to an organic photoconductor including a photosensitive layer disposed on an electrically conductive base. In such embodiments, the photosensitive layer is 1) a photosensitive layer in which a charge-generation layer including at least a charge-generating material and a charge-transport layer including at least a charge-transporting material and a binder resin are stacked in that order, or 2) a photosensitive layer including at least the charge-generating material, the charge-transporting material, and the binder resin, and the binder resin is a terpolymer polycarbonate resin represented by general formula (I) below.

General formula (I)

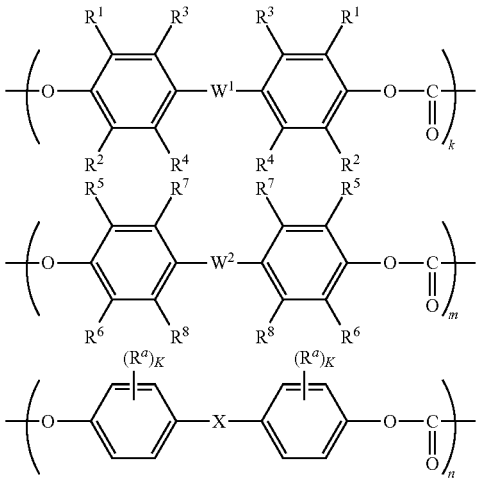

In general formula (I), k+m+n=1 and 0.3≤k+m≤0.8; $W^1$ and $W^2$ each independently represent a single bond, —O—, or —CO—; $R^1$ to $R^8$ and $R^a$ each independently represent a hydrogen atom, an alkyl group, or an aryl group; K represents an integer of 0 to 4; and X represents an alkylidene group or a cycloalkylidene group; provided that the case where $R^1$ and $R^5$ are the same, $R^2$ and $R^6$ are the same, $R^3$ and $R^7$ are the same, $R^4$ and $R^8$ are the same, and $W^1$ and $W^2$ are the same simultaneously is excluded.

There are two types of electrophotographic photoconductors, i.e., single-layer and multilayer type. More specifically, as understood by those skilled in the art, a single-layer electrophotographic photoconductor generally refers to an electrophotographic photoconductor in which the charge-generating and charge-transport functions are provided in the same layer, although the single-layer electrophotographic photoconductor may comprise one or more layers. The electrophotographic photoconductor of the present disclosure can be applied to both types of electrophotographic photoconductors, namely, single-layer and multilayer types.

In the specification and claims of the present application, a resin included in a charge-transport layer of a multilayer electrophotographic photoconductor or in a photosensitive layer of a single-layer electrophotographic photoconductor is referred to as a "binder resin". In the case where a charge-generation layer of a multilayer electrophotographic photoconductor includes a resin, the resin included in the charge-generation-layer is referred to as a "base resin".

A multilayer electrophotographic photoconductor and a single-layer electrophotographic photoconductor, in accordance with some embodiments, will be described below in that order. It will be understood, however, that the illustrative embodiments described below are not exclusive; for example, those skilled in the art will understand that one or more intervening layers, or one or more overlying layers, or both, may be provided in various implementations.

First, a multilayer electrophotographic photoconductor according to some embodiments will be described below. FIG. 1A is a cross-sectional view showing an example of an illustrative multilayer electrophotographic photoconductor.

As shown in FIG. 1A, a multilayer electrophotographic photoconductor 10 can be produced by forming a charge-generation layer 12 including a charge-generating material by vapor deposition, application, or the like on an electrically conductive base 11, and then applying a coating liquid including a charge-transporting material and a specific binder resin onto the charge-generation layer 12, followed by drying to form a charge-transport layer 13.

By appropriately selecting the type of charge-transporting material, the multilayer electrophotographic photoconductor can be applied to either a positively or negatively charging method.

Figure 1B:
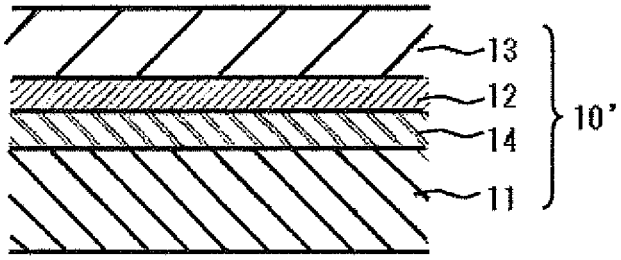

FIG. 1B is a cross-sectional view showing another example of an illustrative multilayer electrophotographic photoconductor according to some embodiments.

As shown in the multilayer electrophotographic photoconductor 10' of FIG. 1B, in some implementations it-may be preferable to form an undercoat layer 14 in advance on an electrically conductive base 11 before forming a photosensitive layer.

A possible reason such an implementation may be preferable in some embodiments is that by providing the undercoat layer 14, charges on the side of the electrically conductive base 11 can be prevented from entering the photosensitive layer, binding of the photosensitive layer to the electrically conductive base 11 may be strengthened, and the surface of the electrically conductive base 11 can be smoothed by covering surface defects.

Regarding the multilayer electrophotographic photoconductor according to some embodiments such as depicted in FIGS. 1A and 1B, the electrically conductive base and the photosensitive layer will be described below in that order.

The electrically conductive base used in the multilayer electrophotographic photoconductor according to some embodiments is not particularly limited as long as it can be used as an electrically conductive base of an electrophotographic photoconductor. Specifically, for example, at least a surface portion of the electrically conductive base is composed of an electrically conductive material.

That is, specifically, for example, the electrically conductive base may be composed of an electrically conductive material, or the electrically conductive base may have a structure in which the surface of a body composed of a plastic material or the like (e.g., which may have low electrical conductivity and/or be insulating) is covered with an electrically conductive material.

Non-limiting examples of the electrically conductive material in accordance with some embodiments include aluminum, iron, copper, tin, platinum, silver, vanadium, molybdenum, chromium, cadmium, titanium, nickel, palladium, indium, stainless steel, and brass.

Furthermore, as the electrically conductive material, one kind of electrically conductive material may be used, or two or more kinds may be used in combination, for example, as an alloy or the like.

Among the materials described above, aluminum or an aluminum alloy may be preferable or particularly well suited for implementing the conductive base according to some embodiments.

Thereby, it is possible that such embodiments may provide a electrophotographic photoconductor that can form a better image.

A possible reason for preferred images possibly being provided by some implementations of a photoconductor employing an aluminum or aluminum alloy conductive base is that, in some implementations, using such a conductive base provides for charges being satisfactorily transferred from the photosensitive layer to the electrically conductive base.

The shape of the electrically conductive base can be selected appropriately in accordance with the structure of an image-forming apparatus to be used. For example, a sheet-like base, a drum-like base, or the like can be used.

Materials used for a photosensitive layer of a multilayer electrophotographic photoconductor according to some embodiments will be described below.

In some embodiments, the multilayer electrophotographic photoconductor includes a structure in which a charge-generation layer including at least a charge-generating material and a charge-transport layer including at least a charge-transporting material and a binder resin are stacked on an electrically conductive base, and the charge-generation layer may include a base resin.

The binder resin, the charge-transporting material, the charge-generating material, and the base resin according to some embodiments will be described below in that order.

The binder resin used in some implementations for the charge-transport layer in the multilayer electrophotographic photoconductor may be a terpolymer polycarbonate resin represented by general formula (I) below.

General formula (I)

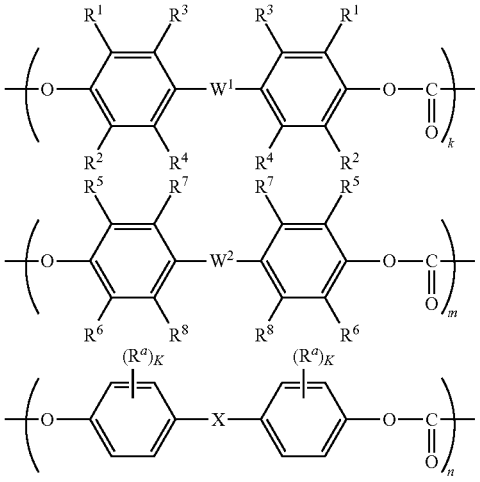

In general formula (I), k+m+n=1 and 0.3≤k+m≤0.8; $W^1$ and $W^2$ each independently represent a single bond, —O—, or —CO—; $R^1$ to $R^8$ and $R^a$ each independently represent a hydrogen atom, an alkyl group, or an aryl group; K represents an integer of 0 to 4; and X represents an alkylidene group or a cycloalkylidene group; provided that the case where $R^1$ and $R^5$ are the same, $R^2$ and $R^6$ are the same, $R^3$ and $R^7$ are the same, $R^4$ and $R^8$ are the same, and $W^1$ and $W^2$ are the same simultaneously is excluded.

The terpolymer polycarbonate resin represented by general formula (I) is a terpolymer having a repeat unit including three types of bisphenol compounds.

In some embodiments of the present disclosure, using a terpolymer polycarbonate resin as the binder resin constituting the charge-transport layer of the electrophotographic photoconductor may be preferable with respect to preventing the charge-transporting material from being crystallized and/or improving the abrasion resistance of the electrophotographic photoconductor.

In general formula (I), the sum k+m is required to be 0.3 to 0.8. When the sum k+m is 0.3 or more, the abrasion resistance of the electrophotographic photoconductor improves, which is preferable. When the sum k+m is 0.8 or less, compatibility between the charge-transporting material and the binder resin improves, which is preferable.

Setting the sum k+m of the terpolymer polycarbonate resin represented by general formula (I) in such a range is well suited to provide for obtaining an electrophotographic photoconductor having excellent abrasion resistance.

In the case where the substituents $R^1$ to $R^8$ and $R^a$ of the terpolymer polycarbonate resin represented by general formula (I) are each an alkyl group, the alkyl group is preferably an alkyl group having 1 to 12 carbon atoms, more preferably an alkyl group having 1 to 8 carbon atoms, and particularly preferably an alkyl group having 1 to 6 carbon atoms.

In the case where the substituents represented by R1 to R8 and Ra are each an alkyl group, specific examples of the alkyl group include a methyl group, an ethyl group, an n-propyl group, an iso-propyl group, an n-butyl group, a sec-butyl group, a tert-butyl group, an n-pentyl group, an iso-pentyl group, a tert-pentyl group, a neopentyl group, an n-hexyl group, an iso-hexyl group, an n-heptyl group, an n-octyl group, a 2-ethylhexyl group, a tert-octyl group, an n-nonyl group, an n-decyl group, and an n-undecyl group.

In the case where the substituents $R^1$ to $R^8$ and $R^a$ of the terpolymer polycarbonate resin represented by general formula (I) are each an aryl group, the aryl group is preferably a phenyl group or a group formed by fusing 2 to 6 benzene rings or linking the benzene rings through a single bond.

The number of benzene rings included in the aryl group is preferably 1 to 6, more preferably 1 to 3, and particularly preferably 1 or 2.

In the case where the substituents represented by $R^1$ to $R^8$ and $R^a$ are each an aryl group, specific examples of the aryl group include a phenyl group, a naphthyl group, a biphenyl group, an anthryl group, a phenanthryl group, and a pyrenyl group.

$W^1$ and $W^2$ of the terpolymer polycarbonate resin represented by general formula (I) are each a single bond, —O—, or —CO—. Among them, a single bond may be more preferable.

According to some embodiments, using a binder resin in which $W^1$ and $W^2$ are each a single bond is well suited for obtaining an electrophotographic photoconductor particularly having excellent abrasion resistance.

The method for producing the terpolymer polycarbonate resin is not particularly limited. The terpolymer polycarbonate resin can be produced, for example, in accordance with a known method for producing a polycarbonate resin, using three types of bisphenol compounds corresponding to the repeat unit shown in general formula (I).

The terpolymer polycarbonate resin may be a random terpolymer or a block terpolymer as long as it provides the desired characteristics.

Furthermore, the viscosity-average molecular weight of the terpolymer polycarbonate resin according to some implementations is preferably 5,000 to 200,000, and more preferably 20,000 to 60,000.

Setting the viscosity-average molecular weight of the terpolymer polycarbonate resin in such a range may be well suited with respect to the binder resin having a moderate hardness, and the charge-transporting material being satisfactorily dispersed in the binder resin. Thus, it is possible to obtain an electrophotographic photoconductor having excellent abrasion resistance and electrical properties.

The viscosity-average molecular weight [M] of the terpolymer polycarbonate resin can be calculated from Schnell's formula: $[\eta]=1.23\times10^4M^{0.83}$ after determining the intrinsic viscosity [η] with an Ostwald viscometer.

Note that [η] can be measured using a polycarbonate resin solution obtained by dissolving a polycarbonate resin in methylene chloride as a solvent at 20° C. such that the concentration is 6.0 g/dm$^3$.

The terpolymer polycarbonate resin may include another resin within the range that does not impair the desired characteristics of the electrophotographic photoconductor.

Illustrative examples of the other resin that can be included by the binder resin of the charge-transport layer include a polyarylate resin, a styrene-butadiene copolymer, a styrene-acrylonitrile copolymer, a styrene-maleic acid copolymer, an acrylic copolymer, a styrene-acrylic acid copolymer, a polyethylene resin, an ethylene-vinyl acetate copolymer, a chlorinated polyethylene resin, a polyvinyl chloride resin, a polypropylene resin, an ionomer resin, a vinyl chloride-vinyl acetate copolymer, an alkyd resin, a polyamide resin, a polyurethane resin, a polysulfone resin, a diallyl phthalate resin, a ketone resin, a polyvinyl acetal resin, a polyvinyl butyral resin, a polyether resin, a silicone resin, an epoxy resin, a phenolic resin, a urea resin, a melamine resin, an epoxy acrylate resin, and a urethane-acrylate resin.

The charge-transporting material is not particularly limited as long as it can be used as a charge-transporting material included in a photosensitive layer of an electrophotographic photoconductor.

Examples of the charge-transporting material generally include a hole-transporting material and an electron-transporting material.

Examples of the hole-transporting material that can be used according to some implementations include nitrogen-including cyclic compounds and condensed polycyclic compounds, such as benzidine derivatives, oxadiazole compounds (e.g., 2,5-di(4-methylaminophenyl)-1,3,4-oxadiazole), styryl compounds (e.g., 9-(4-diethylaminostyryl)anthracene), carbazole compounds (e.g., polyvinylcarbazole), organic polysilane compounds, pyrazoline compounds (e.g., 1-phenyl-3-(p-dimethylaminophenyl) pyrazoline), hydrazone compounds, triphenylamine compounds, indole compounds, oxazole compounds, isoxazole compounds, triazole compounds, thiadiazole compounds, imidazole compounds, pyrazole compounds, and triazole compounds. Among these, triphenylamine compounds may be preferable, and a triphenylamine compound represented by general formula (II) or (III) below may be more preferable.

General formula (II)

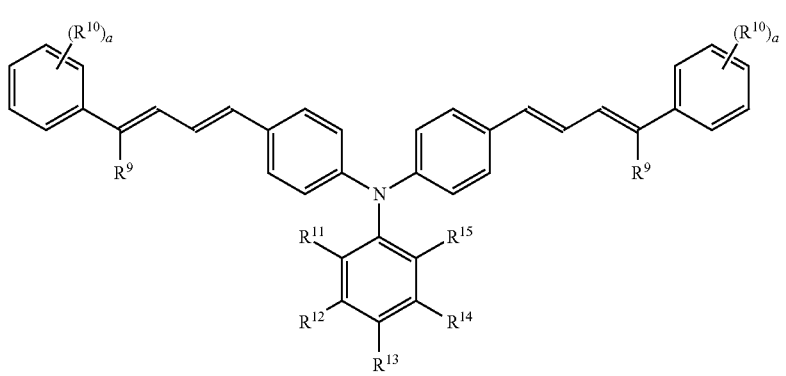

In general formula (II), $R^9$ to $R^{15}$ each independently represent a hydrogen atom, an alkyl group, an alkoxy group, or an aryl group; two adjacent groups selected from $R^{11}$ to $R^{15}$ may bind to each other to form a ring; and a represents an integer of 0 to 5.

General formula (III)

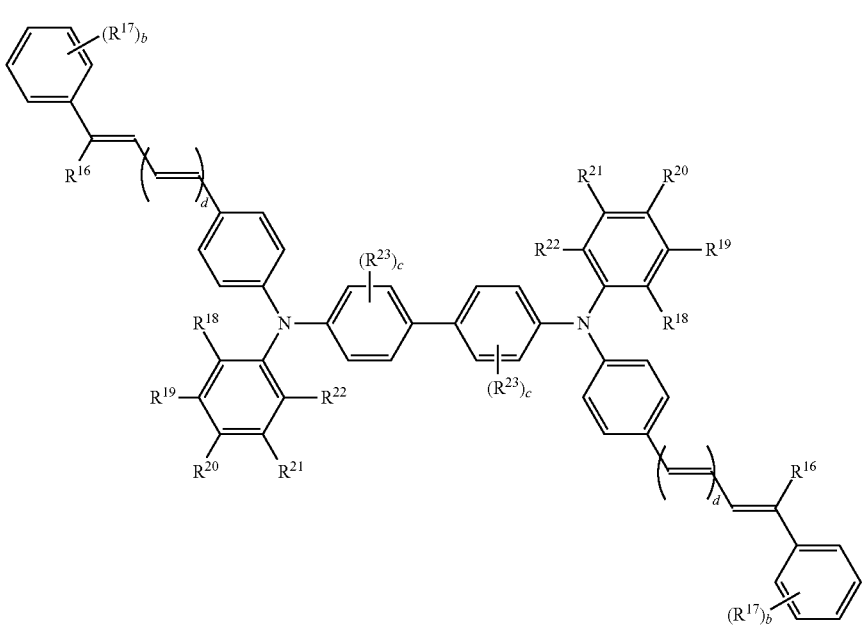

In general formula (III), $R^{16}$ to $R^{23}$ each independently represent a hydrogen atom, an alkyl group, an alkoxy group, or an aryl group; b represents an integer of 0 to 5; c represents an integer of 0 to 4; and d represents 0 or 1.

In the case where the substituents $R^9$ to $R^{23}$ possessed by the compound represented by general formula (II) or (III) are each an alkyl group, the alkyl group is preferably an alkyl group having 1 to 12 carbon atoms, more preferably an alkyl group having 1 to 8 carbon atoms, and particularly preferably an alkyl group having 1 to 6 carbon atoms.

In the case where the substituents represented by $R^9$ to $R^{23}$ are each an alkyl group, specific examples of the alkyl group include a methyl group, an ethyl group, an n-propyl group, an iso-propyl group, an n-butyl group, a sec-butyl group, a tert-butyl group, an n-pentyl group, an iso-pentyl group, a tert-pentyl group, a neopentyl group, an n-hexyl group, an iso-hexyl group, an n-heptyl group, an n-octyl group, a 2-ethylhexyl group, a tert-octyl group, an n-nonyl group, an n-decyl group, and an n-undecyl group.

Furthermore, in the compound represented by general formula (II), two adjacent groups selected from $R^{11}$ to $R^{15}$ may bind to each other to form a ring. In the case where two adjacent groups selected from $R^{11}$ to $R^{15}$ form a ring, the ring is preferably a four- to eight-membered ring, and more preferably a five- to six-membered ring.

In the case where the substituents $R^9$ to $R^{23}$ possessed by the compound represented by general formula (II) or (III) are each alkoxy group, the alkoxy group is preferably an alkoxy group having 1 to 12 carbon atoms, more preferably an alkoxy group having 1 to 8 carbon atoms, and particularly preferably an alkoxy group having 1 to 6 carbon atoms.

In the case where the substituents represented by $R^9$ to $R^{23}$ are each an alkoxy group, specific examples of the alkoxy group include a methoxy group, an ethoxy group, an n-propyloxy, an iso-propyloxy group, an n-butyloxy group, a sec-butyloxy group, a tert-butyloxy group, an n-pentyloxy group, an iso-pentyloxy group, a tert-pentyloxy group, a neopentyloxy group, an n-hexyloxy group, an iso-hexyloxy group, an n-heptyloxy group, an n-octyloxy group, a 2-ethylhexyloxy group, a tert-octyloxy group, an n-nonyloxy group, an n-decyloxy group, an n-undecyloxy group, and an n-dodecyloxy group.

In the case where the substituents $R^9$ to $R^{23}$ possessed by the compound represented by general formula (II) or (III) are each an aryl group, the aryl group is preferably a phenyl group or a group formed by fusing 2 to 6 benzene rings or linking the benzene rings through a single bond. The number of benzene rings included in the aryl group is preferably 1 to 6, more preferably 1 to 3, and particularly preferably 1 or 2.

In the case where the substituents represented by $R^9$ to $R^{23}$ are each an aryl group, specific examples of the aryl group include a phenyl group, a naphthyl group, a biphenyl group, an anthryl group, a phenanthryl group, and a pyrenyl group.

The electron-transporting material that can be used is not particularly limited as long as it can be used as an electron-transporting material included in a photosensitive layer of an electrophotographic photoconductor. Specific examples thereof that may be used in some embodiments include quinone derivatives, such as naphthoquinone derivatives, diphenoquinone derivatives, anthraquinone derivatives, azoquinone derivatives, nitroanthraquinone derivatives, and dinitroanthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromomaleic anhydride.

Among these, quinone derivatives are more preferable in some embodiments.

The charge-generating material used for the photosensitive layer in the multilayer electrophotographic photoconductor is not particularly limited as long as it can be used as a charge-generating material of an electrophotographic photoconductor. Specific examples thereof that may be used in some embodiments include X-form metal-free phthalocyanine (x-H2Pc), Y-form oxotitanyl phthalocyanine (Y-TiOPc), perylene pigments, bis-azo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (e.g., selenium, selenium-tellurium, selenium-arsenic, cadmium sulfide, and amorphous silicon), pyrylium salts, anthanthrone-based pigments, triphenylmethane-based pigments, threne-based pigments, toluidine-based pigments, pyrazoline-based pigments, and quinacridone-based pigments.

Furthermore, the charge-generating material may be used alone or in combination of two or more so as to have an absorption wavelength in a desired region.

In particular, in an image-forming apparatus with a digital optical system, such as a laser beam printer or facsimile machine, using a semiconductor laser light source or the like, an electrophotographic photoconductor having sensitivity in a wavelength range of 700 nm or more is required, and therefore, among the charge-generating materials described above, for example, a phthalocyanine-based pigment, such as metal-free phthalocyanine or oxotitanyl phthalocyanine, may be used.

The crystal form of the phthalocyanine-based pigment is not particularly limited, and phthalocyanine-based pigments having various crystal forms can be used.

Furthermore, in an image-forming apparatus with an analog optical system, such as an electrostatic copying machine, using a white light source, such as a halogen lamp, an electrophotographic photoconductor having sensitivity in the visible region is required, and therefore, for example, a perylene pigment, a bis-azo pigment, or the like may be used.

In the case where a charge-generation layer is formed by applying a solution including a charge-generating material on an electrically conductive base, a base resin may be used together with the charge-generating material.

In a multilayer photoconductor, usually, a photosensitive layer is formed by stacking a charge-generation layer and a charge-transport layer in that order, and therefore, a resin different from the binder resin is selected as the base resin in the same photoconductor so that the base resin is not dissolved in a coating solvent for the charge-transport layer.

Specific examples of the base resin that may be used in some embodiments include a styrene-butadiene copolymer, a styrene-acrylonitrile copolymer, a styrene-maleic acid copolymer, an acrylic copolymer, a styrene-acrylic acid copolymer, a polyethylene resin, an ethylene-vinyl acetate copolymer, a chlorinated polyethylene resin, a polyvinyl chloride resin, a polypropylene resin, an ionomer resin, a vinyl chloride-vinyl acetate copolymer, an alkyd resin, a polyamide resin, a polyurethane resin, a polysulfone resin, a diallyl phthalate resin, a ketone resin, a polyvinyl acetal resin, a polyvinyl butyral resin, a polyether resin, a silicone resin, an epoxy resin, a phenolic resin, a urea resin, a melamine resin, an epoxy acrylate resin, and a urethane-acrylate resin. The base resin for the charge-generation layer may be used alone or in combination of two or more.

An illustrative method for producing a photosensitive layer in a multilayer electrophotographic photoconductor according to some embodiments will be described below.

In some embodiments, the photosensitive layer in a multilayer electrophotographic photoconductor is produced by stacking a charge-generation layer and a charge-transport layer in that order on an electrically conductive base or on an undercoat layer formed on an electrically conductive base.

In the multilayer electrophotographic photoconductor according to some implementations, the thickness of the charge-generation layer is preferably about 0.1 to about 5 μm, and more preferably about 0.1 to about 3 μm. The thickness of the charge-transport layer is preferably about 2 to about 100 μm, and more preferably about 5 to about 50 μm.

The content of the charge-generating material in the charge-generation layer is not particularly limited provided the desired characteristics of the electrophotographic photoconductor are achieved. In the case where the charge-generation layer is formed by application of a coating liquid, the amount of the charge-generating material is preferably about 10 to about 500 parts by mass, and more preferably about 30 to about 300 parts by mass, relative to 100 parts by mass of the base resin.

The content of the charge-transporting material in the charge-transport layer is preferably about 30 to about 50 parts by mass relative to 100 parts by mass of the binder resin.

According to some embodiments, when the content is about 30 parts by mass or more, the charge-transporting material functions satisfactorily, which is preferable.

Additionally, in some such embodiments, when the content is about 50 parts by mass or less, the change in thickness due to repeated printing decreases, and excellent abrasion resistance is exhibited, which is preferable.

Note that the amount of the charge-transporting material corresponds to the sum of the amount of the hole-transporting material and the amount of the electron-transporting material in the charge-transport layer. By setting the content of the charge-transporting material in such a range in accordance with some embodiments, the charge-transporting material is prevented from being crystallized, and it is possible to obtain a multilayer electrophotographic photoconductor having excellent abrasion resistance.

As the method of forming the charge-generation layer, vacuum vapor deposition of a charge-generating material or application of a coating liquid including at least a charge-generating material, a base resin, and a solvent may be used.

As the method of forming a charge-generation layer, from the standpoint that an expensive vapor deposition apparatus is not needed and the film-forming operation is easy, application of a coating liquid for formation of the charge-generation layer including at least a charge-generating material, a base resin, and a solvent is preferable.

Furthermore, as the method of forming a charge-transport layer, application of a coating liquid for formation of charge-transport layer including at least a charge-transporting material, a binder resin, and a solvent may be used.

As the solvent used for preparing the coating liquids, various organic solvents conventionally used in coating liquids for formation of a charge-generation layer or for formation of a charge-transport layer can be used, but a solvent that does not dissolve the previously applied layer is selected.

Specific examples thereof that may be used in some embodiments include alcohols, such as methanol, ethanol, isopropanol, and butanol; aliphatic hydrocarbons, such as n-hexane, octane, and cyclohexane; aromatic hydrocarbons, such as benzene, toluene, and xylene; halogenated hydrocarbons, such as dichloromethane, dichloroethane, chloroform, carbon tetrachloride, and chlorobenzene; ethers, such as dimethyl ether, diethyl ether, tetrahydrofuran, dioxane, dioxolane, ethylene glycol dimethyl ether, and diethylene glycol dimethyl ether; ketones, such as acetone, methyl ethyl ketone, methyl isobutyl ketone, and cyclohexanone; esters, such as ethyl acetate and methyl acetate; and aprotic polar organic solvents, such as N,N-dimethylformaldehyde, N,N-dimethylformamide, and dimethylsulfoxide.

Various known additives can be added to the coating liquids within the range that does not adversely affect the characteristics of the electrophotographic photoconductor.

Examples of additives to be added to the coating liquids include anti-degradation materials, such as antioxidants, radical scavengers, singlet quenchers, and ultraviolet absorbers; softeners; plasticizers; surface modifiers; extenders; thickening materials; dispersion stabilizers; waxes; acceptors; and donors. Furthermore, in order to improve the dispersibility of the charge-transporting material or the charge-generating material and the smoothness of the surface of the photosensitive layer, a surfactant, a leveling material, or the like may be used.

The method for applying the coating liquids is not particularly limited.

For example, a method using a spin coater, an applicator, a spray coater, a bar coater, a dip coater, a doctor blade, or the like may be used.

The films formed by applying the coating liquids by the method described above are each dried using a high-temperature dryer, a reduced-pressure dryer, or the like to remove the solvent, and thereby a charge-generation layer and a charge-transport layer are obtained. The drying temperature is preferably 40° C. to 150° C. By drying the films of the coating liquids in such a temperature range, the solvent is rapidly removed, and the charge-generation layer and the charge-transport layer each with a uniform thickness can be formed efficiently.

When the drying temperature is too high, the component, such as the charge-transporting material, included in the photosensitive layer may be thermally decomposed, which is not desirable.

In addition, in the case where an undercoat layer is formed on the electrically conductive base, a coating liquid for formation of the undercoat layer is prepared using a resin, inorganic fine particles of zinc oxide, titanium oxide, or the like, and a solvent, and by applying the coating liquid onto the electrically conductive base, followed by drying, an undercoat layer can be formed.

A photosensitive layer of a single-layer electrophotographic photoconductor will be described below in accordance with some embodiments of the present disclosure.

In a single-layer electrophotographic photoconductor, since the photosensitive layer is a single-layer, the production of the electrophotographic photoconductor is easy, and the number of interfaces between layers is small, resulting in excellent optical properties.

Therefore, use of a single-layer electrophotographic photoconductor may be preferable in various implementations.

Figure 2A:
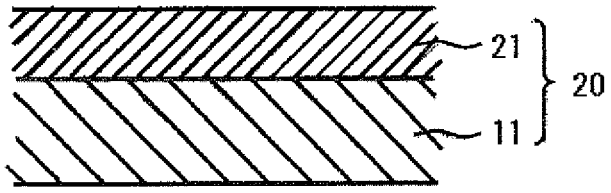
FIGS. 2A and 2B are cross-sectional views each showing structures of a single-layer electrophotographic photoconductor according to some embodiments of the present disclosure.

FIG. 2A is a cross-sectional view showing an example of a single-layer electrophotographic photoconductor according to some embodiments.

As shown in FIG. 2A, in a single-layer electrophotographic photoconductor 20, a single photosensitive layer 21 is provided on an electrically conductive base 11.

The photosensitive layer of the single-layer electrophotographic photoconductor can be formed, for example, by applying a coating liquid, which is obtained by dissolving or dispersing a charge-transporting material, a charge-generating material, a binder resin, and as necessary, a leveling material or the like in an appropriate solvent, onto the electrically conductive base 11, followed by drying.

Figure 2B:
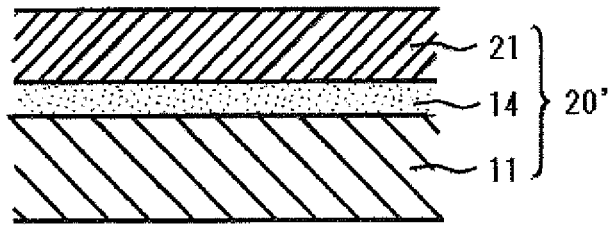

FIG. 2B is a cross-sectional view showing another example of a single-layer electrophotographic photoconductor according to some embodiments.

As shown in a single-layer electrophotographic photoconductor 20' of FIG. 2B, it may be preferable to form a photosensitive layer 21 on an electrically conductive base 11 with an undercoat layer 14 therebetween.

Regarding the single-layer electrophotographic photoconductor, the electrically conductive base and the photosensitive layer according to some embodiments will be described below in that order.

As the electrically conductive base for the single-layer electrophotographic photoconductor, a base composed of the same material as that of the electrically conductive base used for the multilayer electrophotographic photoconductor described above can be used. Furthermore, the shape of the electrically conductive base can be selected appropriately in accordance with the structure of an image-forming apparatus to be used.

For example, a sheet-like base, a drum-like base, or the like can be used.

The major materials constituting the photosensitive layer in the single-layer electrophotographic photoconductor are a binder resin, a charge-transporting material, and a charge-generating material.

As the binder resin, the same resin as the binder resin included in the charge-transport layer of the multilayer electrophotographic photoconductor can be used.

Furthermore, as the charge-transporting material and the charge-generating material, the same materials as those for the multilayer electrophotographic photoconductor can be used.

A method for producing photosensitive layer of a single-layer electrophotographic photoconductor will be described below.

A photosensitive layer of a single-layer electrophotographic photoconductor may be produced according to some embodiments by preparing a coating liquid from a charge-transporting material, a charge-generating material, a binder resin, and a solvent, and using the same method as the method for forming the charge-generation layer and the charge-transport layer in the multilayer electrophotographic photoconductor.

The amount of the charge-transporting material used in the photosensitive layer of the single-layer electrophotographic photoconductor is preferably about 30 to about 50 parts by mass relative to 100 parts by mass of the binder resin. In various implementations, when the amount is about 30 parts by mass or more, the charge-transporting material functions satisfactorily, which is preferable.

Additionally, in some such implementations, when the amount is about 50 parts by mass or less, the change in thickness is small, and excellent abrasion resistance is exhibited, which is preferable.

Note that the amount of the charge-transporting material corresponds to the sum of the amount of the hole-transporting material and the amount of the electron-transporting material in the photosensitive layer.

By setting the content of the charge-transporting material in such a range in accordance with some embodiments, it is possible to obtain a single-layer electrophotographic photoconductor having excellent abrasion resistance and electrical properties.

The amount of the charge-generating material used in the photosensitive layer of the single-layer electrophotographic photoconductor is preferably about 0.01 to about 30 parts by mass, more preferably about 0.1 to about 20 parts by mass, and particularly preferably 0.4 to 10 parts by mass, relative to 100 parts by mass of the binder resin.

Setting the amount of the charge-generating material to be used in such a range is well suited to produce an electrophotographic photoconductor having excellent electrical properties without decreasing the abrasion resistance of the electrophotographic photoconductor.

The thickness of the photosensitive layer of the single-layer electrophotographic photoconductor is not particularly limited as long as the layer functions as a photosensitive layer.

Specifically, for example, in some implementations, the thickness of the photosensitive layer is preferably about 5 to about 100 μm, and more preferably about 10 to about 50 μm.

Some embodiments of the present disclosure also relate to an image-forming apparatus including an image-bearing member, a charging portion operable for charging the surface of the image-bearing member, an exposing portion operable for exposing the surface of the image-bearing member and forming an electrostatic latent image, a developing portion operable for developing the electrostatic latent image to form a toner image, and a transferring portion operable for transferring the toner image from the image-bearing member to a recording media, such as a paper.

The image-forming apparatus according to the present disclosure can be applied to both a monochrome image-forming apparatus and a color image-forming apparatus. Here, by way of example according to some embodiments, description will be made on a tandem-type color image-forming apparatus which uses a plurality of color toners.

An image-forming apparatus according to this embodiment includes a plurality of image-bearing members arranged in order in a predetermined direction so that different color toner images are formed on the surfaces of the image-bearing members, and a plurality of developing portions arranged so as to face their corresponding image-bearing members, the developing portions each being provided with a development roller which supports a toner on the surface thereof, transports the toner, and supplies the transported toner to the surface of the corresponding image-bearing member.

As the image-bearing members, electrophotographic photoconductors according to the foregoing discussed embodiments are used.

Figure 3:
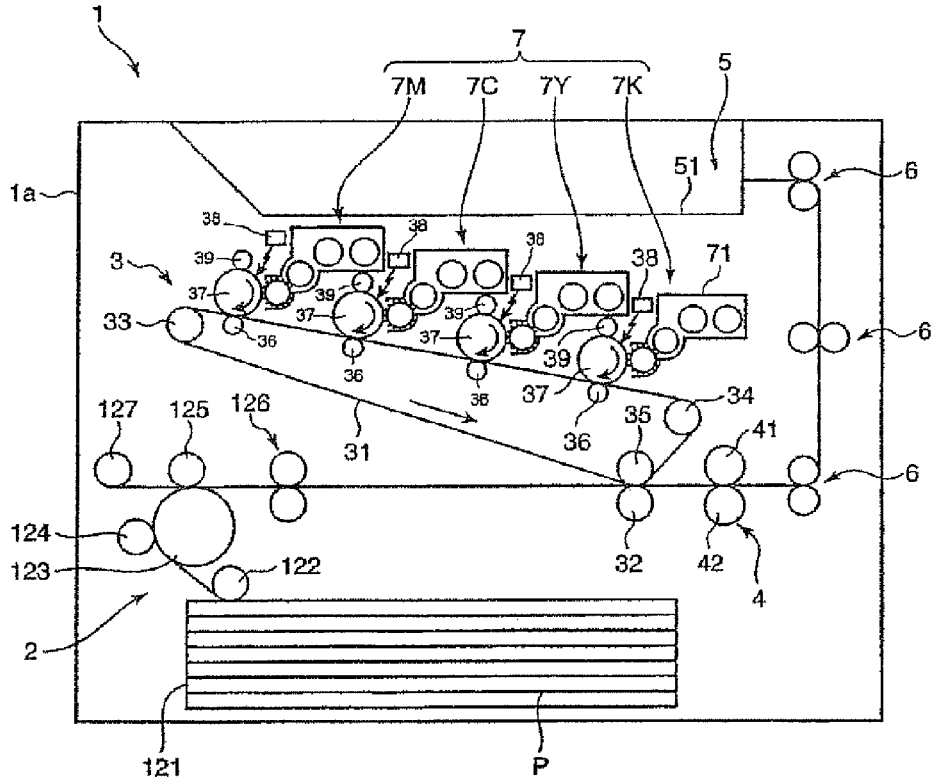
FIG. 3 is a schematic view showing an example of an image-forming apparatus according to an embodiment of the present disclosure.

FIG. 3 is a schematic view showing an embodiment of a color image-forming apparatus of tandem-type provided with electrophotographic photoconductors according to the foregoing discussed embodiments of the present disclosure.

As shown in FIG. 3, a color printer 1 has a box-shaped apparatus main body 1*a* and includes, inside the apparatus main body 1*a*, a paper feeding section 2 which feeds a sheet P, an image-forming section 3 which transfers toner images based on image data and the like to the sheet P while transporting the sheet P fed from the paper feeding section 2, and a fixing section 4 which fixes unfixed toner images, which have been transferred by the image-forming section 3 to the sheet P, on the sheet P.

Furthermore, a paper ejection section 5 is provided on the upper surface of the apparatus main body 1*a*, into which the sheet P subjected to fixing treatment in the fixing section 4 is ejected.

The paper feeding section 2 includes a paper feed cassette 121, a pick-up roller 122, paper feed rollers 123, 124, and 125, and a registration roller 126.

The paper feed cassette 121 is detachably provided to the apparatus main body 1*a* and stores sheets P of various sizes.

The pick-up roller 122 is located on the upper left position of the paper feed cassette 121 as shown in FIG. 3, and picks up the sheets P stored in the paper feed cassette 121 one by one.

The paper feed rollers 123, 124, and 125 send the sheet P picked up by the pick-up roller 122 to a sheet transport path.

The registration roller 126 temporarily holds the sheet P sent to the sheet transport path by the paper feed rollers 123, 124, and 125, and then feeds the sheet P to the image-forming section 3 at a predetermined timing.

The paper feeding section 2 also includes a manual feed tray (not shown) to be mounted on the left side surface of the apparatus main body 1*a* shown in FIG. 3 and a pick-up roller 127.

The pick-up roller 127 picks up a sheet P placed in the manual feed tray. The sheet P picked up by the pick-up roller 127 is sent to the sheet transport path by the paper feed rollers 123 and 125, and is fed to the image-forming section 3 by the registration roller 126 at a predetermined timing.

The image-forming section 3 includes an image forming unit 7, an intermediate transfer belt 31 onto the surface (contact surface) of which a toner image based on image data transmitted from a computer or the like is primary-transferred by the image-forming unit 7, and a secondary transfer roller 32 for secondary-transferring the toner image on the intermediate transfer belt 31 onto a sheet P fed from the paper feed cassette 121.

The image-forming unit 7 includes a unit 7K for black toner development, a unit 7Y for yellow toner development, a unit 7C for cyan toner development, and a unit 7M for magenta toner development which are arranged in that order from the upstream side (the right side in FIG. 3) toward the downstream side.

A drum-shaped electrophotographic photoconductor 37 is disposed in the center of each of the units 7K, 7Y, 7C, and 7M so as to be rotatable in the direction indicated by the arrow (clockwise).

A charging portion 39, an exposing portion 38, a developing portion 71, a cleaning portion (not shown), a static eliminator (not shown), and the like are disposed in that order from the upstream side in the rotation direction.

The charging portion 39 uniformly charges the peripheral surface of the electrophotographic photoconductor 37 rotated in the direction indicated by the arrow.

The charging portion 39 is not particularly limited as long as it can uniformly charge the peripheral surface of the electrophotographic photoconductor 37 and may be of non-contact type or contact type.

Examples of the charging portion include a corona charging portion, a charging roller, and a charging brush.

The image-forming apparatus according to some embodiments of the present disclosure uses an electrophotographic photoconductor having excellent abrasion resistance, and therefore, it is possible to employ a charging portion of contact type, such as a charging roller, as the charging portion 39.

By using the contact charging portion 39, it is possible to suppress emission of active gas, such as ozone or nitrogen oxides, generated from the charging portion 39, and degradation of the photosensitive layer of the electrophotographic photoconductor due to active gas can be prevented. It is also possible to make a design considering the office environment or the like.

In the case where the charging portion 39 includes a charging roller of contact type, the charging roller is not particularly limited as long as it can charge the peripheral surface (surface) of the electrophotographic photoconductor 37 while being in contact with the electrophotographic photoconductor 37.

As the charging roller, for example, a charging roller which rotates following the rotation of the electrophotographic photoconductor 37 while being in contact with the electrophotographic photoconductor 37 may be used.

Furthermore, as the charging roller, for example, a roller at least a surface portion of which is made of a resin may be used.

More specifically, an example of the charging roller includes a metal core rotatably supported around an axis, a resin layer disposed on the metal core, and a voltage-applying portion which applies a voltage to the metal core.

In a charging portion provided with such a charging roller, by applying a voltage to the metal core by the voltage-applying portion, it is possible to charge the surface of the electrophotographic photoconductor 37 which is in contact with the metal core with the resin layer therebetween.

The resin constituting the resin layer of the charging roller is not particularly limited as long as the peripheral surface of the electrophotographic photoconductor 37 can be satisfactorily charged.

Specific illustrative examples of the resin used for the resin layer according to some implementations include a silicone resin, a urethane resin, and a silicone-modified resin.

Furthermore, the resin layer may be incorporated with an inorganic filler.

The voltage to be applied to the charging roller by the voltage-applying portion is preferably a DC voltage only.

The DC voltage to be applied to the electrophotographic photoconductor by the charging roller is preferably 600 to 4,000 V, more preferably 800 to 3,000 V, and particularly preferably 900 to 2,000 V.

In the case where a DC voltage only is applied to the charging roller, the abrasion loss of the photosensitive layer tends to decrease, which is preferable, compared with the case where an AC voltage or a superimposed voltage obtained by superimposing an AC voltage on a DC voltage is applied.

Accordingly, by applying a DC voltage only to the charging roller, a good image can be formed, and moreover, the abrasion loss of the photosensitive layer can be markedly reduced.

The exposing portion 38 is a laser scanning unit and irradiates, with a laser beam based on image data inputted from a personal computer (PC) which is a higher-level portion, the peripheral surface of the electrophotographic photoconductor 37 uniformly charged by the charging portion 39 to form an electrostatic latent image on the electrophotographic photo conductor 37.

The developing portion 71 forms a toner image based on the image data by supplying a toner to the peripheral surface of the electrophotographic photoconductor 37 on which the electrostatic latent image has been formed.

The toner image is primary-transferred onto the intermediate transfer belt 31.

The cleaning portion cleans the residual toner on the peripheral surface of the electrophotographic photoconductor 37 after the toner image has been primary-transferred onto the intermediate transfer belt 31.

The static eliminator eliminates static charges on the peripheral surface of the electrophotographic photoconductor 37 after completion of the primary transfer.

The peripheral surface of the electrophotographic photoconductor 37 which has been subjected to cleaning treatment by the cleaning portion and the static eliminator moves toward the charging portion for new charging treatment and is subjected to charging treatment.

The intermediate transfer belt 31 is an endless belt-shaped rotating member, and is stretched over plural rollers, such as a driving roller 33, a driven roller 34, a back-up roller 35, and a primary transfer roller 36 such that the surface (contact surface) thereof comes into contact with the peripheral surface of each electrophotographic photoconductor 37.

The intermediate transfer belt 31 is configured to be rotated by a plurality of rollers while being pressed against each electrophotographic photoconductor 37 by the primary transfer roller 36 arranged facing the electrophotographic photoconductor 37.

The driving roller 33 is rotated by a driving source, such as a stepping motor, and rotates the intermediate transfer belt 31.

The driven roller 34, the back-up roller 35, and the primary transfer rollers 36 are rotatably provided, and rotate following the rotation of the intermediate transfer belt 31 caused by the driving roller 33.

The rollers 34, 35, and 36 are driven to rotate via the intermediate transfer belt 31 in response to the rotation of the driving roller 33, and support the intermediate transfer belt 31.

The primary transfer roller 36 applies a primary transfer bias having a reverse polarity to the charge polarity of the toner to the intermediate transfer belt 31.

Thereby, the toner images formed on the electrophotographic photoconductors 37 are transferred (primary-transferred) onto the intermediate transfer belt 31 one after another in a superimposed state, the intermediate transfer belt 31 being driven to go around in the direction indicated by the arrow (counterclockwise) by the drive of the driving roller 33 between the electrophotographic photoconductors 37 and their corresponding primary transfer rollers 36.

The secondary transfer roller 32 applies a secondary transfer bias having a reverse polarity to the polarity of the toner image to the sheet P.

Thereby, the toner image primary-transferred onto the intermediate transfer belt 31 is transferred to the sheet P between the secondary transfer roller 32 and the back-up roller 35.

As a result, a color image (unfixed toner image) is formed on the sheet P.

The fixing section 4 fixes the transferred image transferred to the sheet P in the image-forming section 3, and includes a heating roller 41 which is heated with an electrically heating element, and a pressure roller 42 which is arranged so as to face the heating roller 41 and the peripheral surface of which is pressed against the peripheral surface of the heating roller 41.

The transferred image transferred to the sheet P by the secondary transfer roller 32 in the image-forming section 3 is fixed to the sheet P through fixing treatment by heating when the sheet P passes between the heating roller 41 and the pressure roller 42.

The sheet P subjected to the fixing treatment is ejected to the paper ejection section 5.

In the color printer 1 of this embodiment, conveyor rollers 6 are arranged in appropriate places between the fixing section 4 and the paper ejection section 5.

The paper ejection section 5 is formed by recessing the top of the apparatus main body 1*a* of the color printer 1, and a paper output tray 51 for receiving the ejected sheet P is formed at the bottom of the recessed portion.

The color printer 1 forms an image on the sheet P by the image-forming operation described above.

Since the tandem-type image-forming apparatus is provided with electrophotographic photoconductors according to the herein above embodiments as image-bearing members, even if charging portions of contact type are used, a good image can be formed, the abrasion loss of the photosensitive layer can be small, and the image-forming apparatus can have high durability.

The present disclosure will be described in more detail below on the basis of examples. It is to be understood that the present disclosure and the claimed subject matter is not limited thereto.

Example 1

A multilayer electrophotographic photoconductor was produced, in which a charge-generation layer and a charge-transport layer were stacked in that order on an electrically conductive base with an undercoat layer therebetween.

Two parts by mass of titanium oxide subjected to surface treatment with alumina and silica and then subjected to surface treatment with methyl hydrogen polysiloxane by wet dispersion (manufactured by Tayca Corporation, SMT-A (trial product), number-average primary particle size 10 nm) and one part by mass of 6/12/66/610 quarterpolymer polyamide resin (manufactured by Toray Industries, Inc., Amilan CM8000) were subjected to dispersion treatment for 5 hours with a bead mill, using a mixed solvent including 10 parts by mass of methanol, one part by mass of butanol, and one part by mass of toluene. Thereby, a coating liquid for formation of undercoat layer was prepared.

The resulting coating liquid for formation of undercoat layer was filtrated with a filter having an opening of 5 μm, and then applied by dip coating onto an electrically conductive base, which was a drum-shaped support made of aluminum with a diameter of 30 mm and an overall length of 246 mm.

After the coating liquid was applied, treatment was performed at 130° C. for 30 minutes to form an undercoat layer with a thickness of 2.0 μm on the electrically conductive base.

One point five parts by mass of titanyl phthalocyanine (charge-generating material) and one part by mass of a polyvinyl butyral resin (base resin, manufactured by Denki Kagaku Kogyo K. K., Denka Butyral #6000C) were subjected to dispersion treatment for 2 hours with a bead mill, using a mixture of 40 parts by mass of propylene glycol monomethyl ether and 40 parts by mass of tetrahydrofuran as a dispersion liquid. Thereby, a coating liquid for formation of charge-generation layer was prepared.

The resulting coating liquid for formation of charge-generation layer was filtrated with a filter having an opening of 3 μm, and then applied by dip coating onto the undercoat layer.

After the coating liquid was applied, treatment was performed at 50° C. for 5 minutes to form a charge-generation layer with a thickness of 0.3 μm.

Subsequently, by dissolving 40 parts by mass of a hole-transporting material (HTM-1), 2 parts of an electron-transporting material (ETM-1), 8 parts by mass of an additive (Irganox 1010), and 100 parts by mass of a polycarbonate resin (Resin-1, a viscosity-average molecular weight 51,000) as a binder resin in a mixed solvent including 350 parts by mass of tetrahydrofuran and 350 parts by mass of toluene, a coating liquid for formation of charge-transport layer was prepared.

The resulting coating liquid for formation of charge-transport layer was applied onto the charge-generation layer by the same method as that for the charge-generation layer, followed by drying treatment at 120° C. for 40 minutes to form a charge-transport layer with a thickness of 20 μm. Thereby, a multilayer electrophotographic photoconductor was produced.

Examples 2 to 30 and Comparative Examples 1 to 6 electrophotographic photoconductors were produced as in Example 1 except that the type of the hole-transporting material (HTM), the type of the binder resin, and the amount used were changed to those shown in Table 1.

In these Examples and Comparative Examples, HTM-1 to HTM-7 represented by formulae below were used as hole-transporting materials, and ETM-1 represented by formula below was used as an electron-transporting material.

Furthermore, Resin-1 to Resin-10 having repeat units represented by formulae below were used as binder resins.

HTM-1

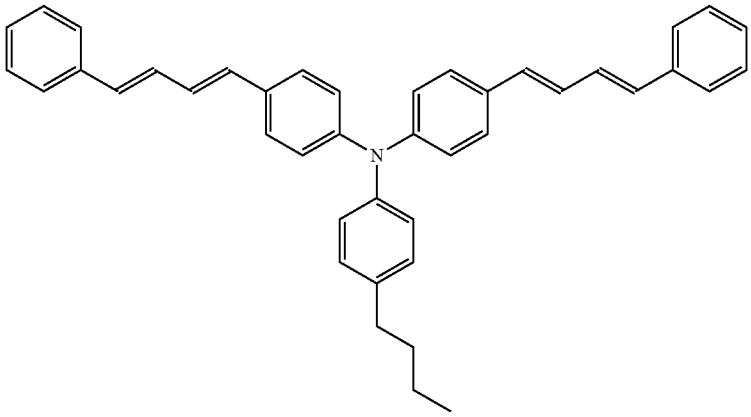

HTM-2

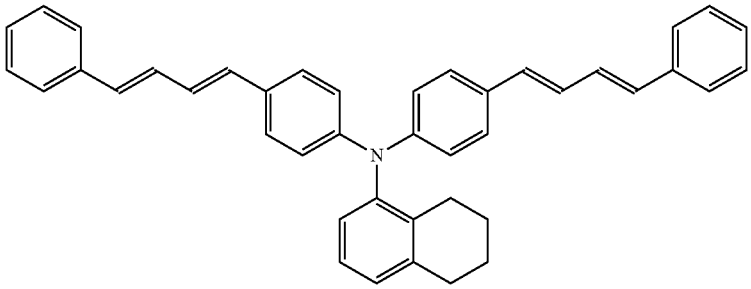

-continued
HTM-3
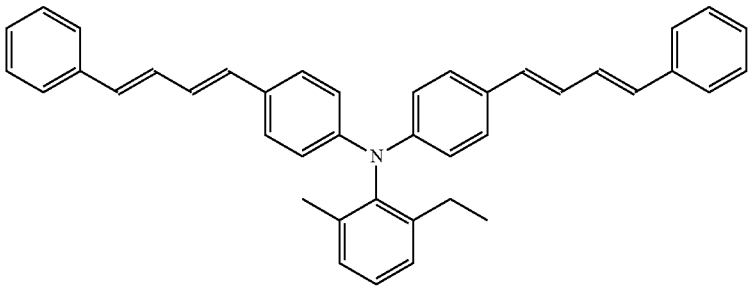
HTM-4
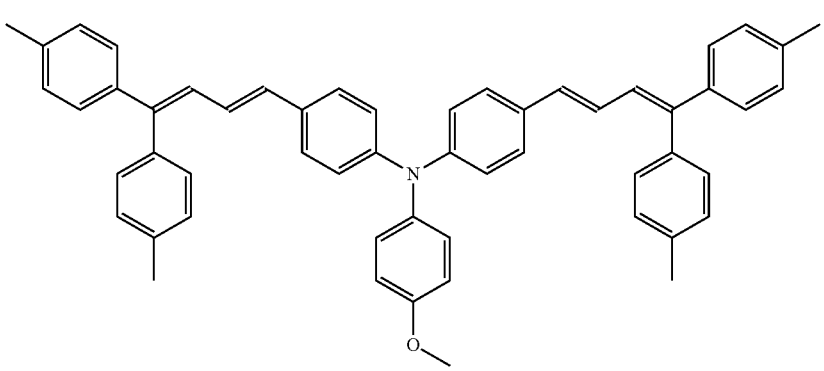
HTM-5
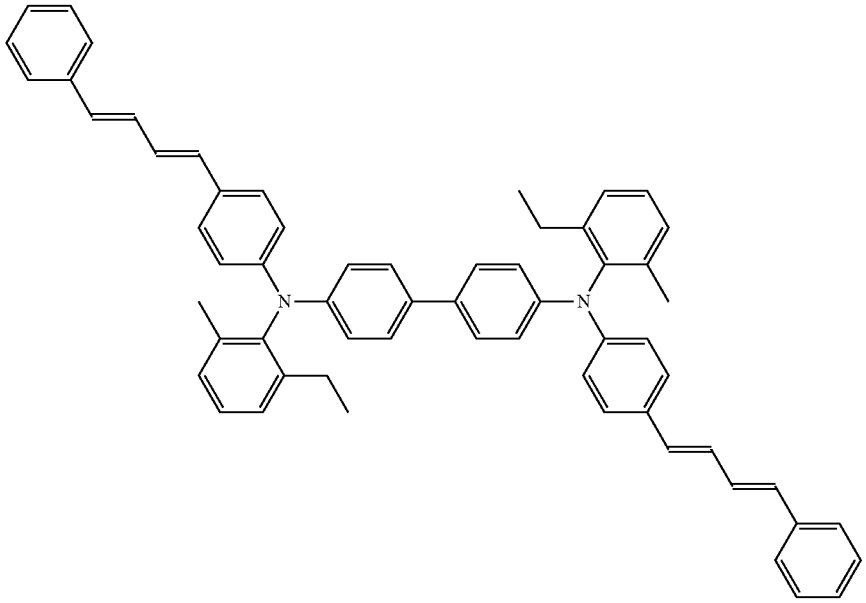

-continued
HTM-6
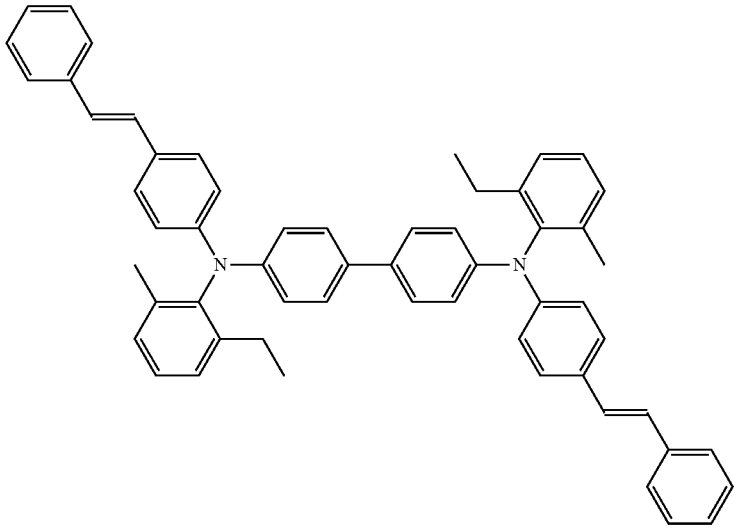
HTM-7
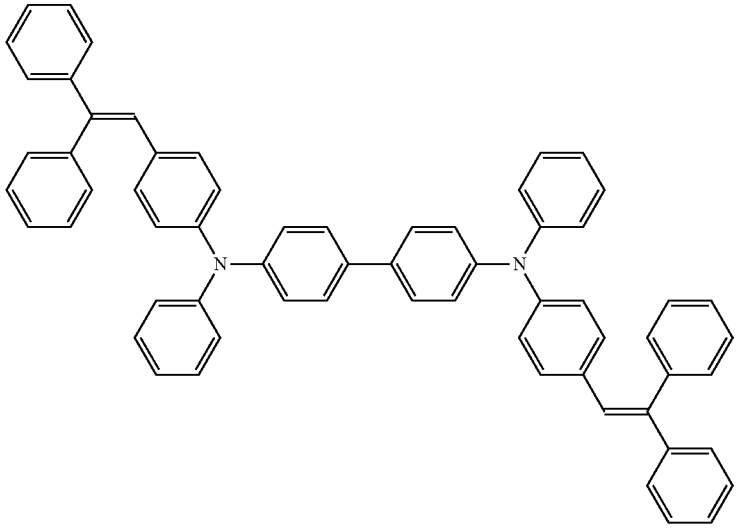
ETM-1
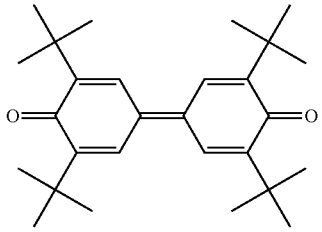
Resin-1
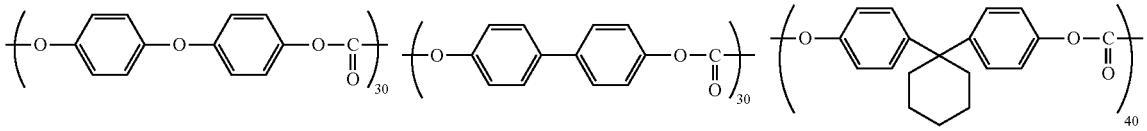
Resin-2
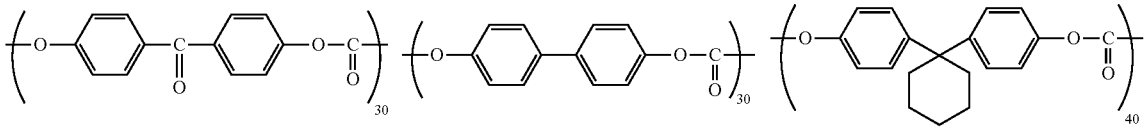

-continued

Resin-3

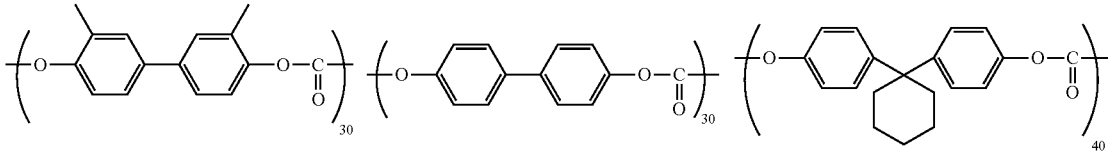

Resin-4

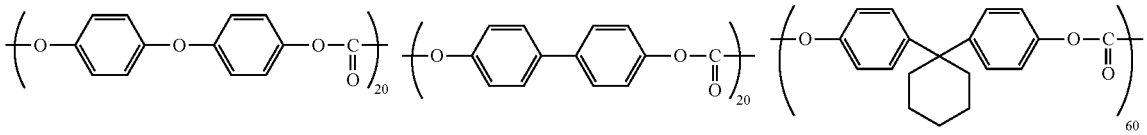

Resin-5

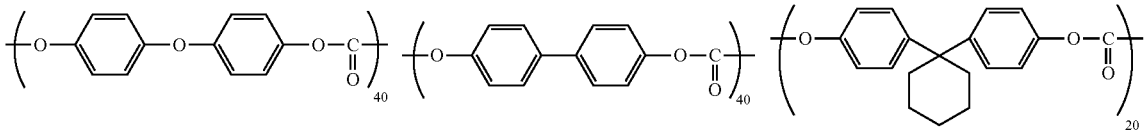

Resin-6

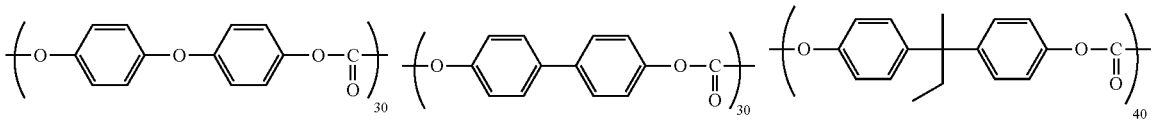

Resin-7

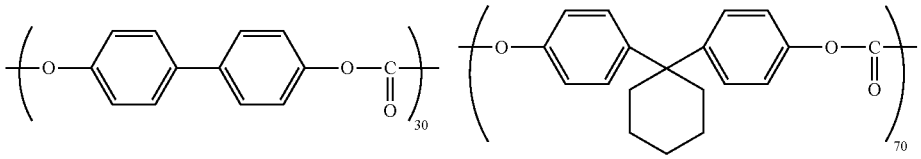

Resin-8

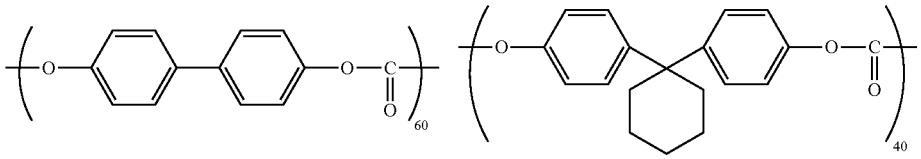

Resin-9

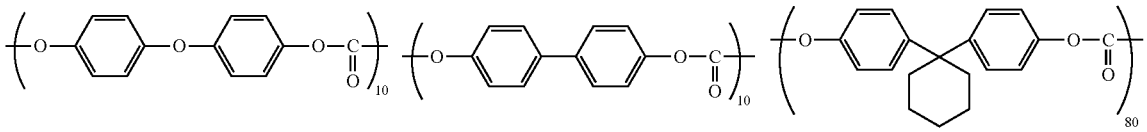

Resin-10

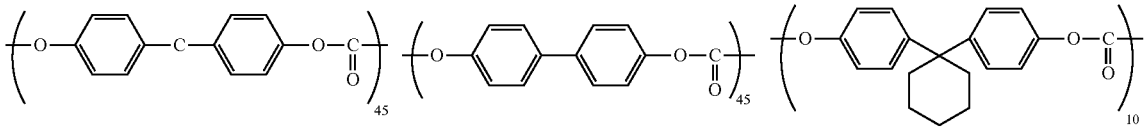

The electrophotographic photoconductors produced in these Examples and Comparative Examples were each mounted on a commercially available printer provided with a charging roller, using a negative development process, and the electrical properties, the change in thickness, and the change in appearance were evaluated according to the methods described below.

Regarding the electrical properties, the image drum unit was modified, the developing member was removed, and the surface potential was measured with a potential probe (surface potential measurement device Model 244 manufactured by Monroe Electronics Inc.), using a given μg.

The surface potential at the time of printing a blank image was designated as $V_0$, and the surface potential at the time of printing a 100% solid image was designated as $V_L$.

Using A4 size paper, blank printing was performed continuously on 10,000 sheets, and the change in the thickness of the photosensitive layer before and after printing was measured.

Specifically, a visual observation was made whether or not there were foreign substances on the surface of the photoconductor, and the diameter of the observed foreign substances was measured with a diameter gauge.

Next, it was determined whether or not the visually observed foreign substances were crystalline using an optical microscope.

That is, in the case where one or more crystals were observed in a foreign substance, the foreign substance was determined to be a crystalline foreign substance.

In the case where a foreign substance was a crystalline foreign substance and the diameter thereof was 0.5 mm or more, it was determined that "crystallization" occurred.

The evaluation results according to the evaluation methods described above are shown in Table 1.

TABLE 1

| | | HTM | | Binder resin | | Electrical properties | | Amount of thickness change | Change in appearance of photoconductor |
|---|---|---|---|---|---|---|---|---|---|
| | | Type | Parts | Type | Parts | $V_O$/V | $V_L$/V | μm | surface |
| Example | 1 | HTM-1 | 40 | Resin-1 | 100 | 446 | 45 | 0.48 | None |
| | 2 | HTM-2 | 40 | Resin-1 | 100 | 479 | 36 | 0.49 | None |
| | 3 | HTM-3 | 40 | Resin-1 | 100 | 458 | 46 | 0.52 | None |
| | 4 | HTM-4 | 40 | Resin-1 | 100 | 462 | 45 | 0.50 | None |
| | 5 | HTM-5 | 40 | Resin-1 | 100 | 450 | 53 | 0.52 | None |
| | 6 | HTM-6 | 40 | Resin-1 | 100 | 460 | 42 | 0.46 | None |
| | 7 | HTM-7 | 40 | Resin-1 | 100 | 462 | 42 | 0.48 | None |
| | 8 | HTM-1 | 40 | Resin-2 | 100 | 464 | 44 | 0.47 | None |
| | 9 | HTM-2 | 40 | Resin-2 | 100 | 455 | 40 | 0.48 | None |
| | 10 | HTM-3 | 40 | Resin-2 | 100 | 460 | 44 | 0.48 | None |
| | 11 | HTM-4 | 40 | Resin-2 | 100 | 451 | 44 | 0.51 | None |
| | 12 | HTM-5 | 40 | Resin-2 | 100 | 440 | 50 | 0.53 | None |
| | 13 | HTM-6 | 40 | Resin-2 | 100 | 453 | 42 | 0.45 | None |
| | 14 | HTM-7 | 40 | Resin-2 | 100 | 461 | 45 | 0.55 | None |
| | 15 | HTM-1 | 40 | Resin-3 | 100 | 462 | 44 | 0.50 | None |
| | 16 | HTM-1 | 40 | Resin-4 | 100 | 464 | 39 | 0.65 | None |
| | 17 | HTM-1 | 40 | Resin-5 | 100 | 470 | 34 | 0.39 | None |
| | 18 | HTM-1 | 40 | Resin-6 | 100 | 463 | 42 | 0.53 | None |
| | 19 | HTM-2 | 40 | Resin-3 | 100 | 455 | 42 | 0.50 | None |
| | 20 | HTM-2 | 40 | Resin-4 | 100 | 464 | 40 | 0.62 | None |
| | 21 | HTM-2 | 40 | Resin-5 | 100 | 464 | 40 | 0.38 | None |
| | 22 | HTM-2 | 40 | Resin-6 | 100 | 459 | 41 | 0.55 | None |
| | 23 | HTM-1 | 30 | Resin-1 | 100 | 459 | 54 | 0.40 | None |
| | 24 | HTM-1 | 45 | Resin-1 | 100 | 461 | 44 | 0.48 | None |
| | 25 | HTM-1 | 50 | Resin-2 | 100 | 463 | 38 | 0.48 | None |
| | 26 | HTM-3 | 40 | Resin-3 | 100 | 459 | 48 | 0.50 | None |
| | 27 | HTM-3 | 40 | Resin-4 | 100 | 457 | 48 | 0.59 | None |
| | 28 | HTM-3 | 40 | Resin-5 | 100 | 455 | 45 | 0.38 | None |
| | 29 | HTM-1 | 20 | Resin-1 | 100 | 460 | 95 | 0.35 | None |
| | 30 | HTM-1 | 25 | Resin-1 | 100 | 455 | 68 | 0.40 | None |
| Comparative Example | 1 | HTM-1 | 40 | Resin-7 | 100 | 452 | 44 | 0.79 | None |
| | 2 | HTM-1 | 40 | Resin-8 | 100 | 455 | 45 | 0.40 | Crystallized |
| | 3 | HTM-1 | 40 | Resin-9 | 100 | 454 | 46 | 0.81 | None |
| | 4 | HTM-1 | 40 | Resin-10 | 100 | — | — | — | Undissolved |
| | 5 | HTM-1 | 30 | Resin-7 | 100 | 456 | 54 | 0.78 | None |
| | 6 | HTM-1 | 50 | Resin-7 | 100 | 460 | 39 | 0.83 | None |

As is evident from Examples 1 to 30, in the electrophotographic photoconductors according to the present disclosure in which a terpolymer polycarbonate resin was used as the binder constituting the charge-transport layer, there is no change in appearance due to crystallization of the charge-transporting material, the change in thickness due to repeated printing is small, and excellent abrasion resistance is exhibited.

In contrast, as is evident from Comparative Examples 1, 5, and 6, in the electrophotographic photoconductors in which a binary copolymer polycarbonate resin (Resin-7) was used as the binder resin, the change in thickness is large, and abrasion occurs in the photosensitive layer.

As is evident from Comparative Example 2, when a binary copolymer polycarbonate (Resin-8) is used as the binder resin, the charge-transporting material is crystallized because of compatibility. Furthermore, as is evident from Comparative Example 3, in the electrophotographic photoconductor in which, even when a terpolymer polycarbonate resin is used as the binder resin, the content in the repeat unit thereof is not within the predetermined range (i.e., the relationship $0.3 \leq k+m \leq 0.8$ in general formula (I) is not satisfied), abrasion resistance is inferior.

As is evident from Comparative Example 4, even when a terpolymer polycarbonate resin is used as the binder resin, in the case where the content in the repeat unit thereof is not within the predetermined range, the charge-transporting material cannot be dissolved in the binder resin, and it is not possible to obtain an electrophotographic photoconductor.

The results of these Examples and Comparative Examples show that in order to obtain an electrophotographic photoconductor in which the charge-transporting material is not crystallized and which has excellent abrasion resistance, it is necessary to use a terpolymer polycarbonate resin, instead of using a binary copolymer polycarbonate resin, and to specify the content in the repeat unit thereof.

Furthermore, as is evident from Examples 1 to 28, by setting the amount of the charge-transporting material to be used at 30 parts by mass or more relative to 100 parts by mass of the binder resin, it is possible to obtain an electrophotographic photoconductor having excellent abrasion resistance and having excellent electrical properties in which the surface potential $V_L$ is 60 V or less.

These results show that by using a terpolymer polycarbonate resin as the binder resin, specifying the content in the repeat unit thereof, and specifying the content of the charge-transporting material relative to the binder resin, it is possible to prevent the crystallization of the charge-transporting material in the photosensitive layer of the electrophotographic photoconductor.

Furthermore, it is possible to obtain an electrophotographic photoconductor in which the charge-transporting material is not crystallized and which has excellent abrasion resistance.

Furthermore, it is also possible to obtain an electrophotographic photoconductor having excellent electrical properties.

Having thus described in detail embodiments of the present disclosure, it is to be understood that the subject matter disclosed by the foregoing paragraphs is not to be limited to particular details and/or embodiments set forth in the above description, as many apparent variations thereof are possible without departing from the spirit or scope of the present disclosure.

What is claimed is:

1. An electrophotographic photoconductor comprising:

an electrically conductive base; and a photosensitive layer disposed on the electrically conductive base, wherein the photosensitive layer has a structure 1) in which a charge-generation layer including at least a charge-generating material and a charge-transport layer including at least a charge-transporting material and a binder resin are stacked in that order, or a structure 2) in which at least the charge-generating material, the charge-transporting material, and the binder resin are included in the same layer; and wherein the binder resin is a terpolymer polycarbonate resin represented by general formula (I) shown below:

General formula (I)

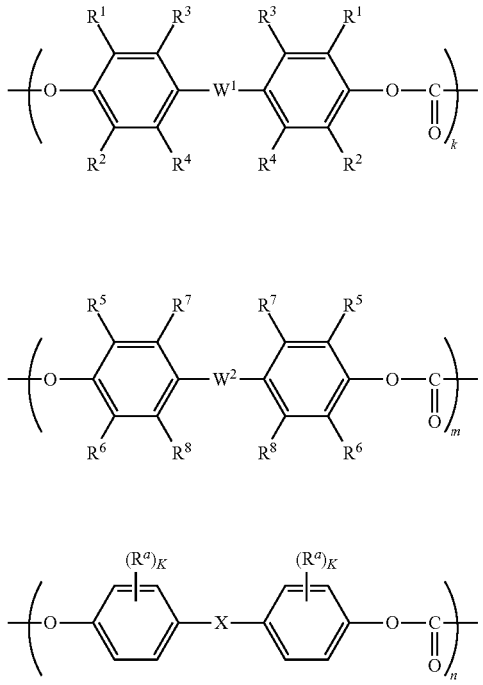

wherein, in general formula (I), $k+m+n=1$ and $0.4 \leq k+m \leq 0.8$;

$W^1$ represents —O— or —CO—;

$W^2$ represents a single bond;

$R^1$ represents a hydrogen atom or a methyl group;

$R^2$ to $R^8$ and $R^a$ each independently represents a hydrogen atom;

K represents 0; and

X represents a cycloalkylidene group.

2. The electrophotographic photoconductor according to claim 1, wherein the charge-transporting material includes, as a hole-transporting material, a compound represented by general formula (II) or (III) shown below:

General formula (II)

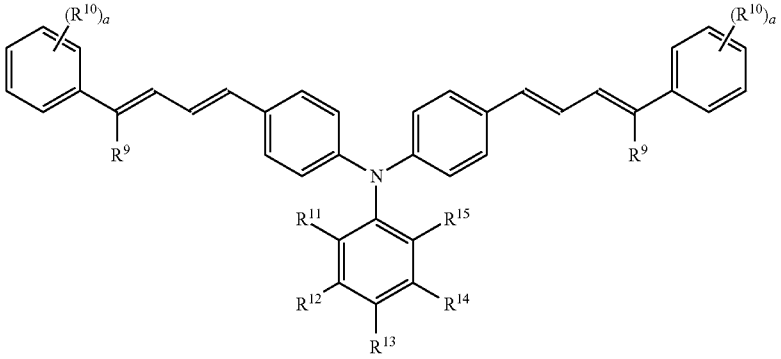

wherein, in general formula (II), $R^9$ to $R^{15}$ each independently represents a hydrogen atom, an alkyl group, an alkoxy group, or an aryl group;

two adjacent groups selected from $R^{11}$ to $R^{15}$ may bind to each other to form a ring; and a represents an integer of 0 to 5, and the image-bearing member;

a charging portion operable for charging the surface of the image-bearing member;

an exposing portion operable for exposing the surface of the image-bearing member and forming an electrostatic latent image;

General formula (III)

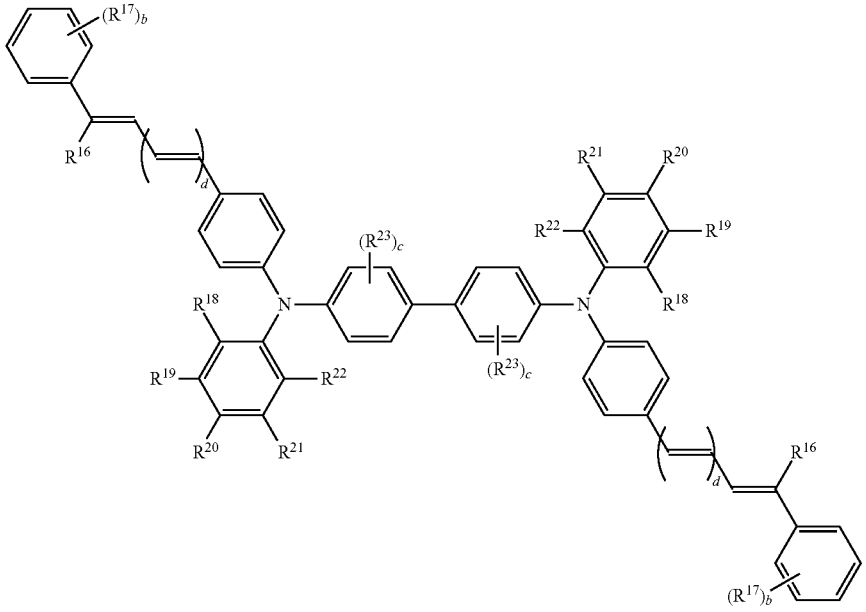

wherein, in general formula (III), $R^{16}$ to $R^{23}$ each independently represents a hydrogen atom, an alkyl group, an alkoxy group, or an aryl group;

b represents an integer of 0 to 5;

c represents an integer of 0 to 4; and d represents 0 or 1.

3. The electrophotographic photoconductor according to claim 1, wherein the content of the charge-transporting material is in the range of about 30 parts by mass to about 50 parts by mass relative to 100 parts by mass of the binder resin.

4. The electrophotographic photoconductor according to claim 1, wherein the charge-transport layer has a thickness of about 5 to about 50 μm.

5. The electrophotographic photoconductor according to claim 1, wherein the photosensitive layer having a structure in which at least the charge-generating material, the charge-transporting material, and the binder resin are included in the same layer has a thickness of about 10 to about 50 μm.

6. The electrophotographic photoconductor according to claim 1, wherein the charge-generating material is X-form metal-free phthalocyanine or titanyl phthalocyanine.

7. An image-forming apparatus having an image-bearing member comprising the electrophotographic photoconductor according to claim 1, the image-forming apparatus comprising:

a developing portion operable for developing the electrostatic latent image to form a toner image; and a transferring portion operable for transferring the toner image from the image-bearing member to a recording member, wherein the charging portion is of contact charging type.

8. An image-forming apparatus comprising:

an image-bearing member;

a charging portion operable for charging the surface of the image-bearing member;

an exposing portion operable for exposing the surface of the image-bearing member and forming an electrostatic latent image;

a developing portion operable for developing the electrostatic latent image to form a toner image; and a transferring portion operable for transferring the toner image from the image-bearing member to a recording media, wherein the image-bearing member comprises the electrophotographic photoconductor according to claim 1.

9. The image-forming apparatus according to claim 8, wherein the charge-transporting material includes, as a hole-transporting material, a compound represented by general formula (II) or (III) shown below:

General formula (II)

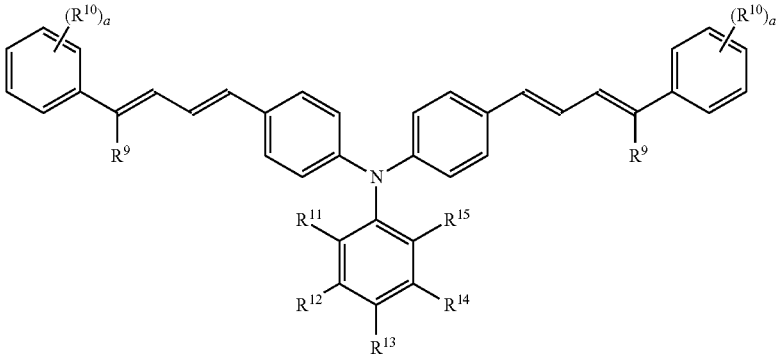

wherein, in general formula (II), $R^9$ to $R^{15}$ each independently represents a hydrogen atom, an alkyl group, an alkoxy group, or an aryl group;

two adjacent groups selected from $R^{11}$ to $R^{15}$ may bind to each other to form a ring; and a represents an integer of 0 to 5, and General formula (III)

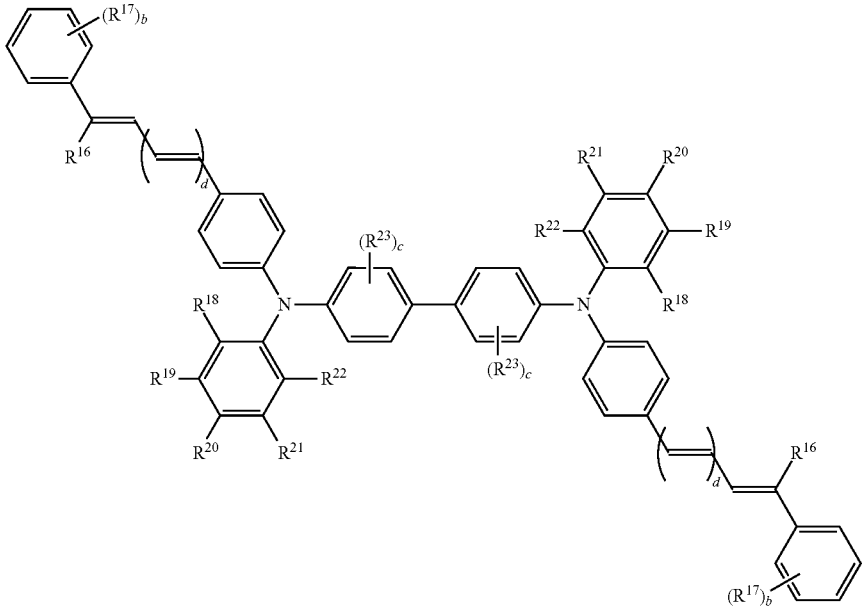

wherein, in general formula (III), $R^{16}$ to $R^{23}$ each independently represents a hydrogen atom, an alkyl group, an alkoxy group, or an aryl group;

b represents an integer of 0 to 5;

c represents an integer of 0 to 4; and d represents 0 or 1.

10. The image-forming apparatus according to claim 8, wherein the content of the charge-transporting material is about 30 to about 50 parts by mass relative to 100 parts by mass of the binder resin.

11. The image-forming apparatus according to claim 8, wherein the charge-transport layer has a thickness of about 5 to about 50 μm.

12. The image-forming apparatus according to claim 8, wherein the photosensitive layer having a structure in which at least the charge-generating material, the charge-transporting material, and the binder resin are included in the same layer has a thickness of about 10 to about 50 μm.

13. The image-forming apparatus according to claim 8, wherein the charge-generating material is X-form metal-free phthalocyanine or titanyl phthalocyanine.

14. The image-forming apparatus according to claim 8, wherein the charging portion is of contact charging type.

15. The image-forming apparatus according to claim 14, wherein the charging portion is a charging roller of contact charging type.

16. The image-forming apparatus according to claim 15, wherein in the charging portion, a DC voltage only is applied to the charging roller.

* * * * *